US010329087B2

(12) United States Patent
Holman

(10) Patent No.: US 10,329,087 B2
(45) Date of Patent: Jun. 25, 2019

(54) TRANSPORT CARRIER WITH ENHANCED LOADING/UNLOADING

(71) Applicant: STONEBROOKE EQUIPMENT, INC., Burnsville, MN (US)

(72) Inventor: Jerry D. Holman, Lakeville, MN (US)

(73) Assignee: STONEBROOKE EQUIPMENT, INC., Burnsville, MN (US)

( * ) Notice: Subject to any disclaimer, the term of this patent is extended or adjusted under 35 U.S.C. 154(b) by 0 days.

(21) Appl. No.: 16/018,557

(22) Filed: Jun. 26, 2018

(65) Prior Publication Data

US 2019/0002199 A1 Jan. 3, 2019

Related U.S. Application Data

(60) Provisional application No. 62/526,587, filed on Jun. 29, 2017.

(51) Int. Cl.

| | |
|---|---|
| ***B65F 1/14*** | (2006.01) |
| ***A61G 21/00*** | (2006.01) |
| ***A61G 19/00*** | (2006.01) |

(52) U.S. Cl.

CPC ..... *B65F 1/1468* (2013.01); *A61G 19/00* (2013.01); *A61G 21/00* (2013.01)

(58) Field of Classification Search

CPC ..... A61G 19/00; A61G 21/00; B65F 1/1468; B60P 1/02; B60P 1/025; B60P 1/44; B60P 1/6418

USPC ..... 27/27, 32; 296/16, 18; 414/495, 531, 414/800, 679

See application file for complete search history.

(56) References Cited

U.S. PATENT DOCUMENTS

| | | | | |
|---|---|---|---|---|
| 1,925,964 | A * | 9/1933 | Koppe | A61G 21/00 27/27 |
| 3,019,920 | A * | 2/1962 | Hillenbrand | A61G 21/00 414/531 |
| 3,372,819 | A * | 3/1968 | Kellogg | A61G 19/00 414/461 |
| 6,758,648 | B1 * | 7/2004 | Eekhoff | A61G 21/00 414/495 |
| 6,932,401 | B1 * | 8/2005 | Eekhoff | A61G 21/00 296/16 |
| 7,014,237 | B1 * | 3/2006 | Eekhoff | A61G 21/00 296/16 |
| 8,905,454 | B2 * | 12/2014 | Stock | A61G 21/00 296/18 |

(Continued)

*Primary Examiner* — William L Miller

(74) *Attorney, Agent, or Firm* — Honigman LLP

(57) ABSTRACT

A transport container includes a frame structure, a housing, and an extendable and retractable platform that is movable between a retracted position and an extended position. Spaced apart shelves are disposed at opposite sides of the housing and are adjustable between a lowered position, where the support surfaces are at or near a level of the platform, and a raised position, where the support surfaces are raised above the platform. Articles are placed on the extended platform and then the platform is retracted so that the first articles are disposed partially over the support surfaces of the shelves. The shelves are raised to the raised position to raise the plurality of first articles above the platform, whereby the platform is extended to have a plurality of second articles placed thereon and retracted so that the second articles are disposed on the platform below the shelves and the first articles.

20 Claims, 17 Drawing Sheets

(56) References Cited

U.S. PATENT DOCUMENTS

2012/0282076 A1* 11/2012 Stock ..... A61G 21/00
414/800

* cited by examiner

TRANSPORT CARRIER WITH ENHANCED LOADING/UNLOADING

CROSS REFERENCE TO RELATED APPLICATION

The present application claims the filing benefits of U.S. provisional application Ser. No. 62/526,587, filed Jun. 29, 2017, which is hereby incorporated herein by reference in its entirety.

FIELD OF THE INVENTION

The present invention relates generally to transport carriers or containers for transporting large articles and, more particularly, to a transport container for transporting multiple caskets in a vehicle.

BACKGROUND OF THE INVENTION

Typically, caskets or coffins are manually loaded one-by-one into a carrier or trailer of a transport vehicle or truck body. The carrier or trailer or truck body has two fixed shelves along the walls of the truck to provide two levels of loaded caskets. The caskets are manually loaded one at a time into the truck by one or more people. The task of loading multiple caskets is time consuming and difficult due to the requirement that the loading personnel have to walk or crawl the caskets back into the truck to place the casket on the fixed shelves or the floor of the truck.

SUMMARY OF THE INVENTION

The present invention provides a transport carrier or container for transporting a plurality of articles (such as caskets or coffins or other large-scale items). The transport carrier comprises an extendable and retractable bed slide or platform or ramp that is extended for loading articles thereon. The transport carrier also comprises spaced apart raisable/lowerable shelves that are disposed along opposite sides of the carrier, with the platform (when retracted) disposed between the shelves. The loaded platform is retracted such that (when the shelves are lowered) the opposite ends of the articles are disposed over the respective shelves, such that the shelves are raised to lift the articles above the platform. The platform is then extended for loading of additional articles and then retracted so that the platform and additional articles are disposed below the shelves and first-loaded articles.

Therefore, the present invention provides a transport carrier or container for transporting two rows or levels of articles (such as caskets). The bed slide and shelves are cooperatively operated to load the articles into the carrier and to unload the articles from the trailer. The transport carrier can be loaded by a single operator (who may extend/retract the platform by actuating one or more buttons or the like and who may raise/lower the shelves by actuating one or more buttons or the like), while avoiding any requirement for the operator to walk or crawl into the transport carrier to load or unload the articles. Because the articles are loaded without requiring any loading operator to walk into the carrier, the present invention provides a low profile carrier that is easier to load and unload by a single operator.

These and other objects, advantages, purposes and features of the present invention will become apparent upon review of the following specification in conjunction with the drawings.

DESCRIPTION OF THE PREFERRED EMBODIMENTS

Figure 1:
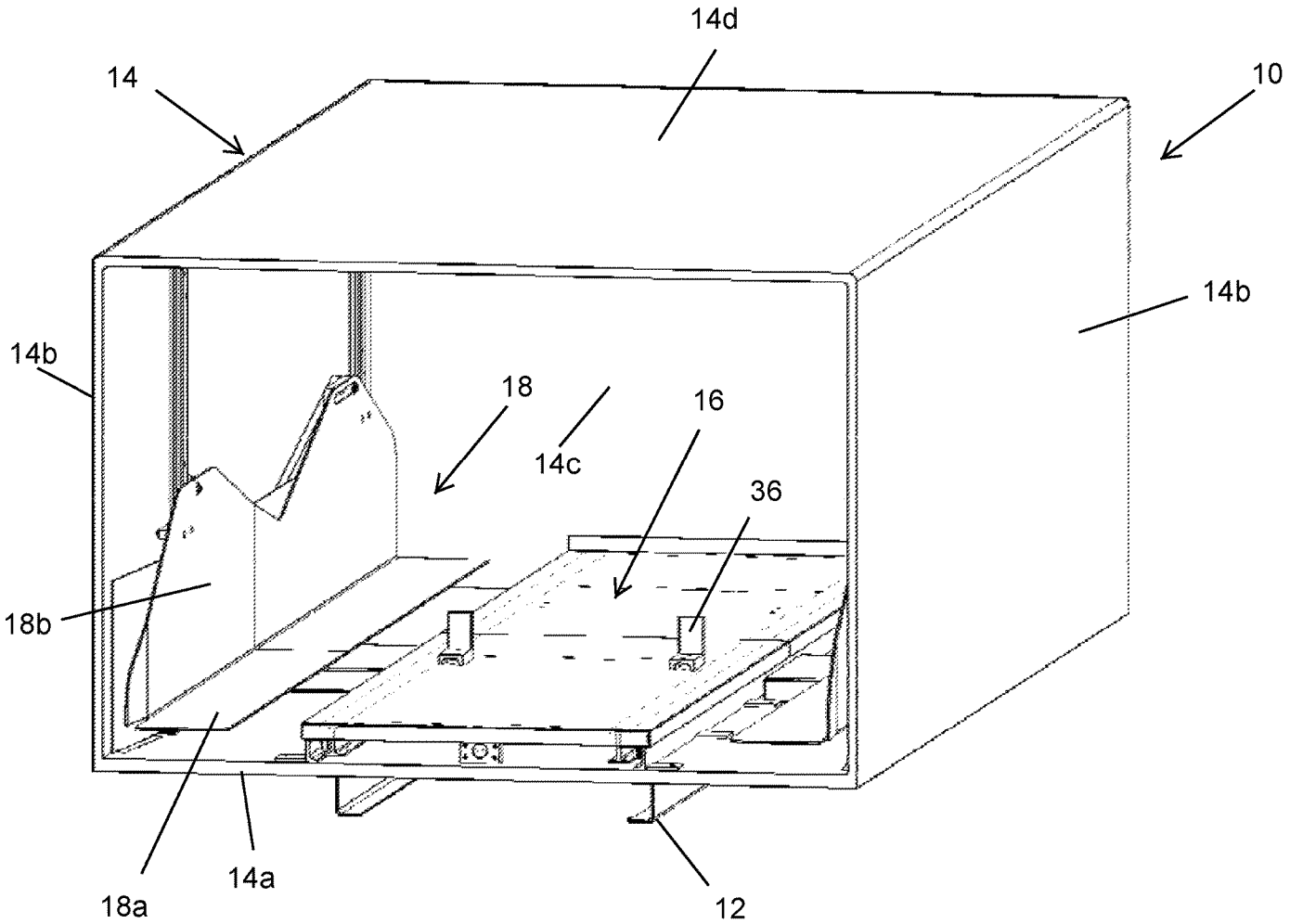
FIG. 1 is a perspective view of a transport container in accordance with the present invention, shown with the shelf lowered and the bed slide retracted.
Figure 2:
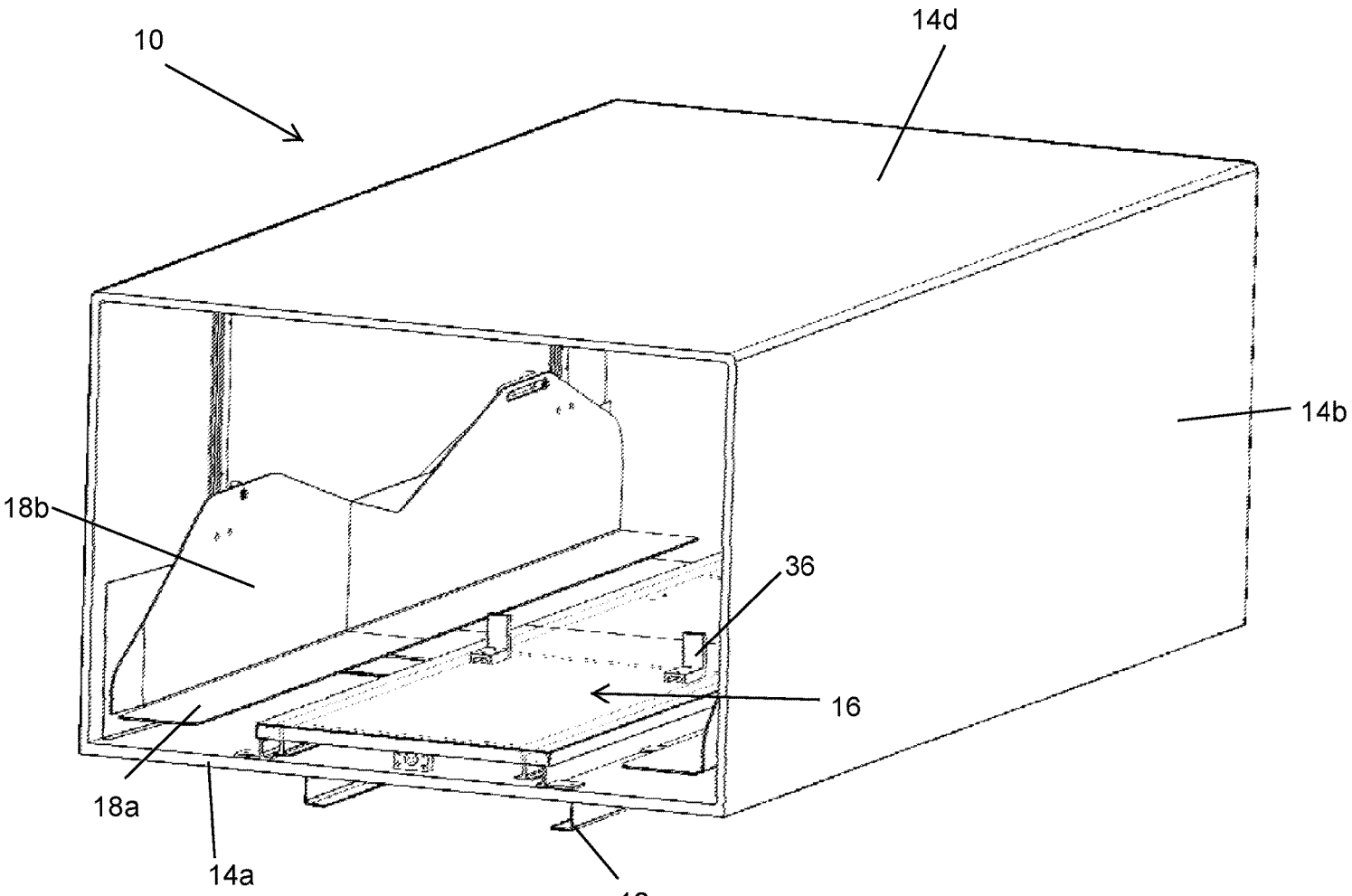
FIG. 2 is another perspective view of the transport container of FIG. 1.
Figure 3:
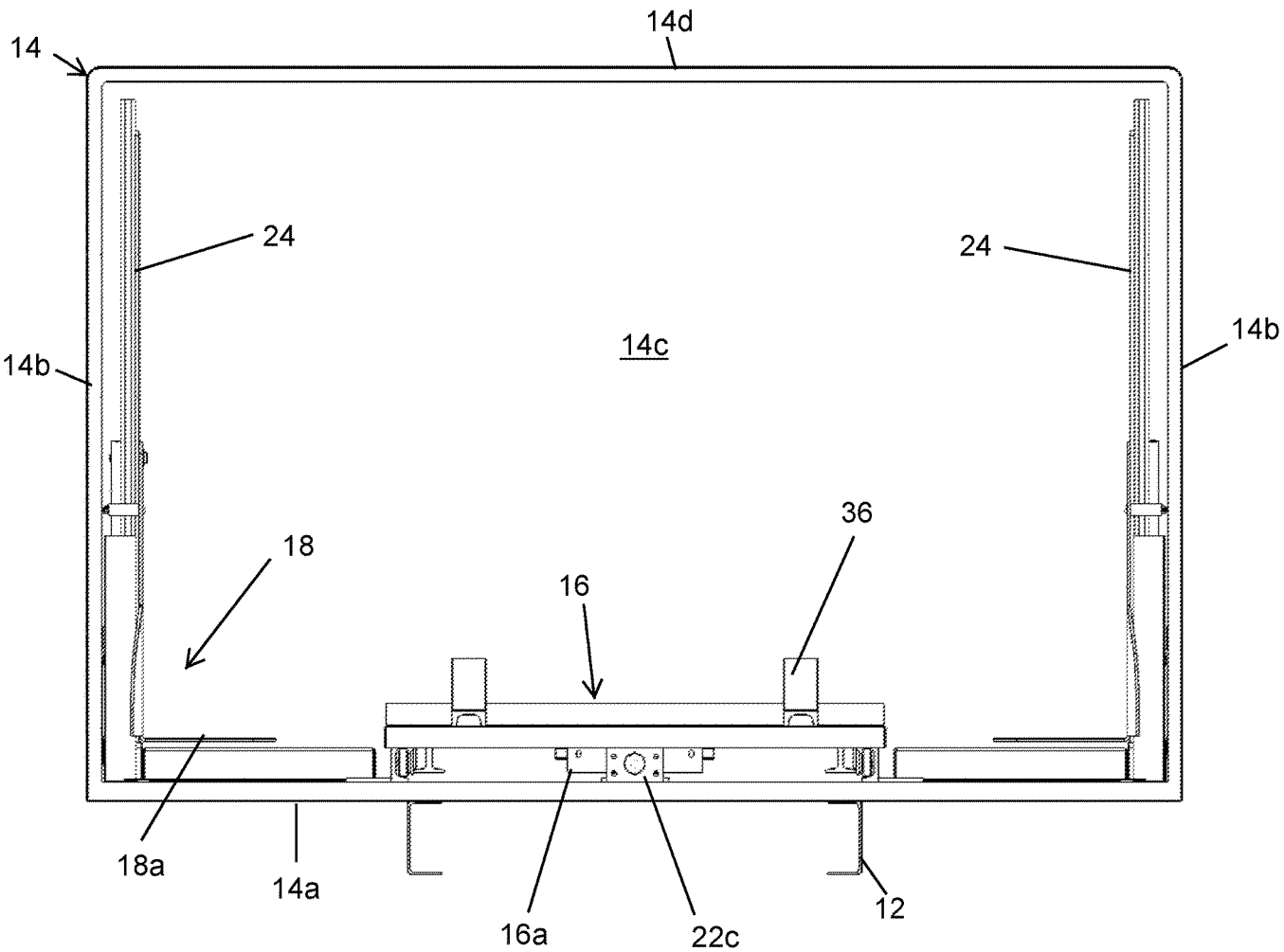
FIG. 3 is a front elevation of the transport container of FIG. 1.
Figure 4:
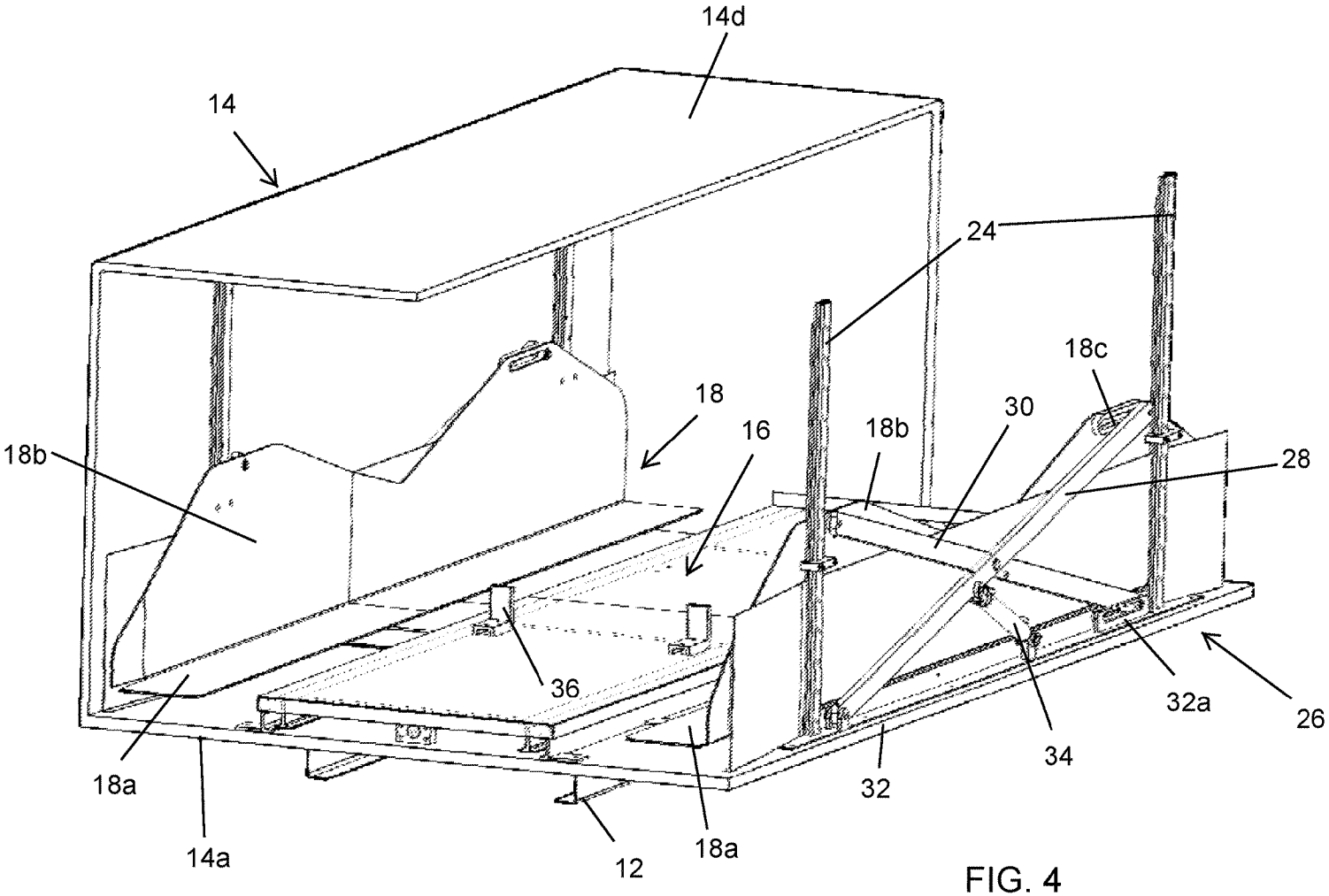
FIG. 4 is another perspective view of the transport container of FIG. 1, shown with a portion of the outer walls removed to show additional detail.
Figure 5:
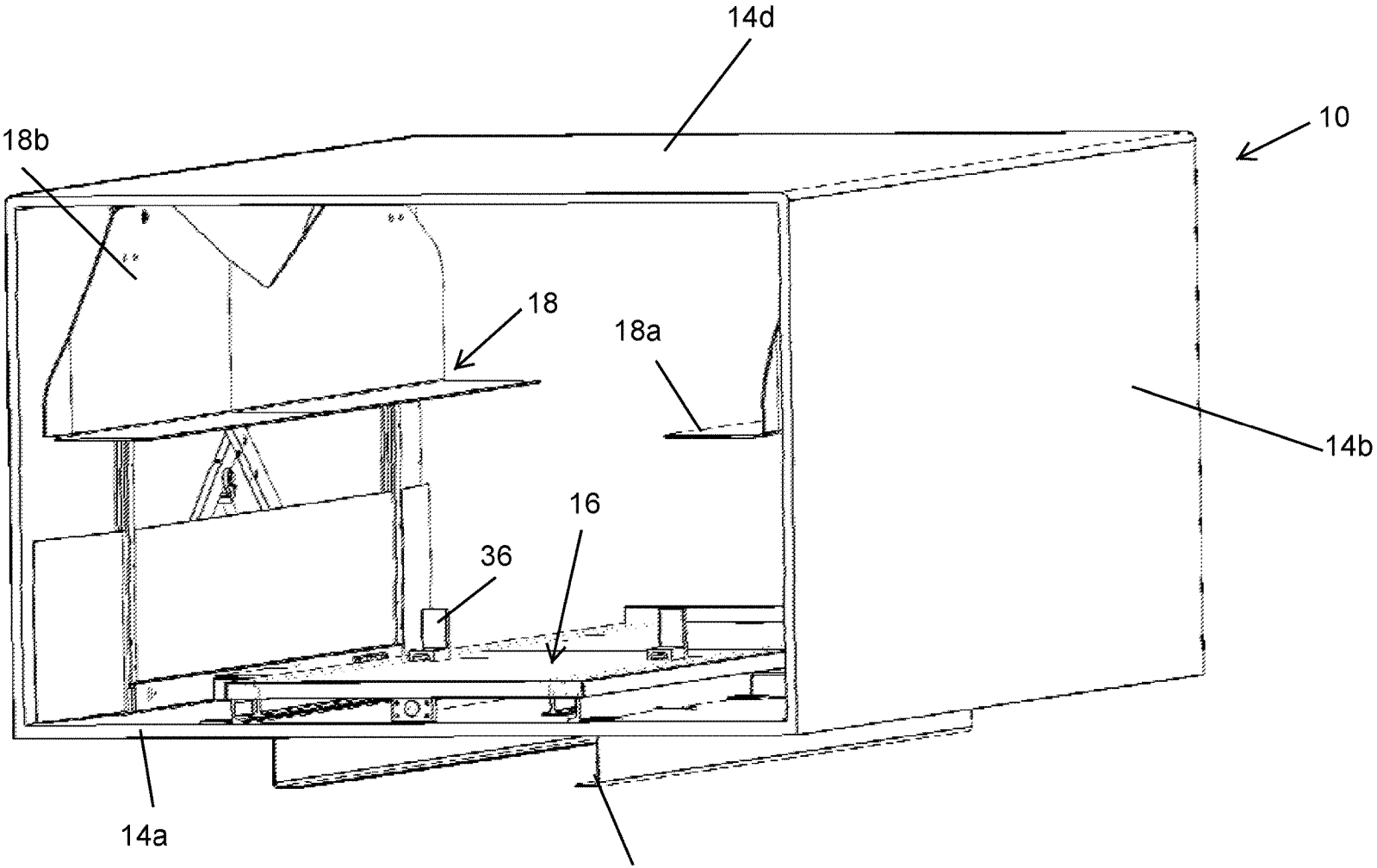
FIG. 5 is a perspective view of the transport container of the present invention, shown with the shelf raised and the bed slide retracted.
Figure 6:
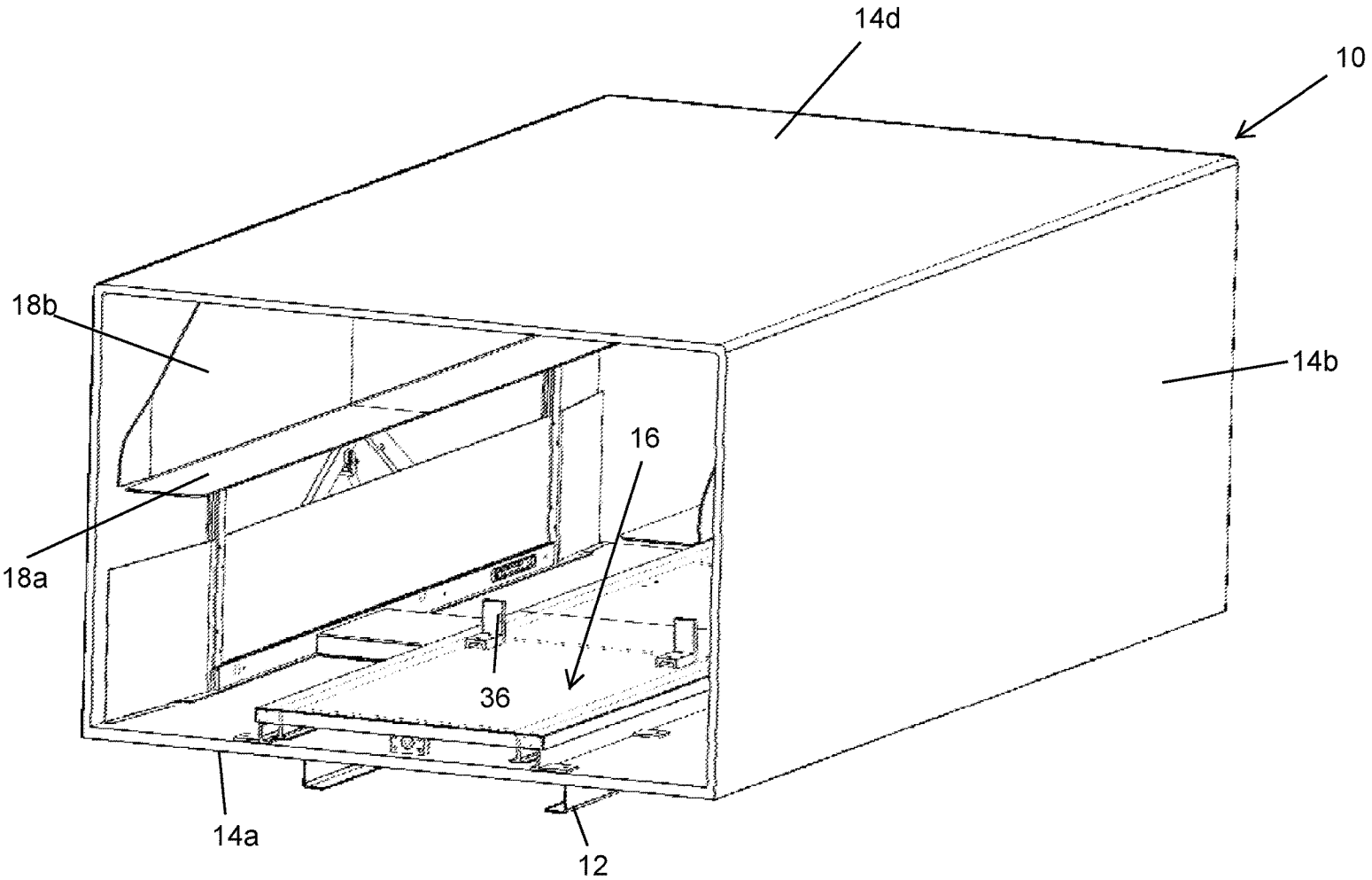
FIG. 6 is another perspective view of the transport container of FIG. 5.
Figure 7:
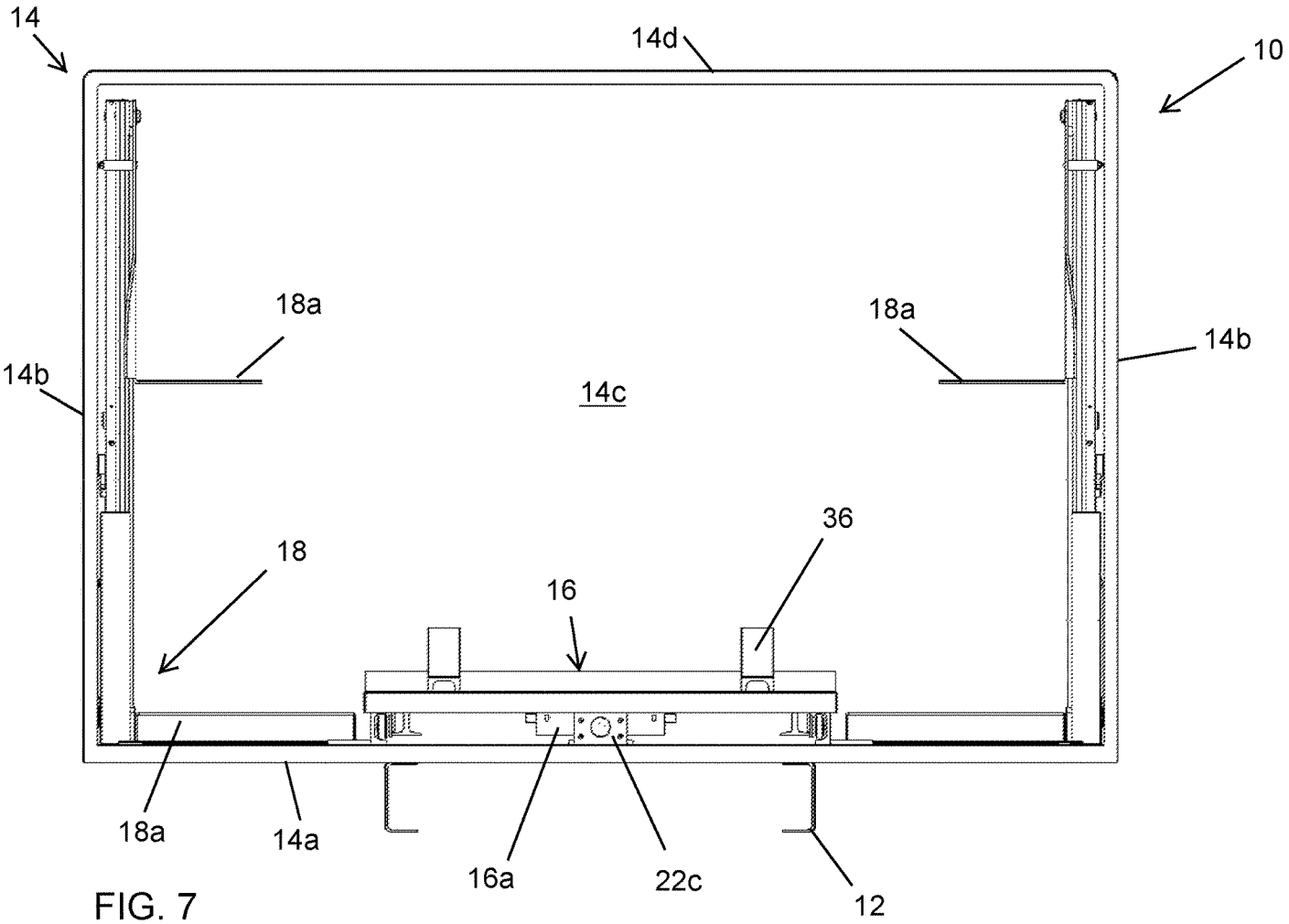
FIG. 7 is a front elevation of the transport container of FIG. 5.
Figure 8:
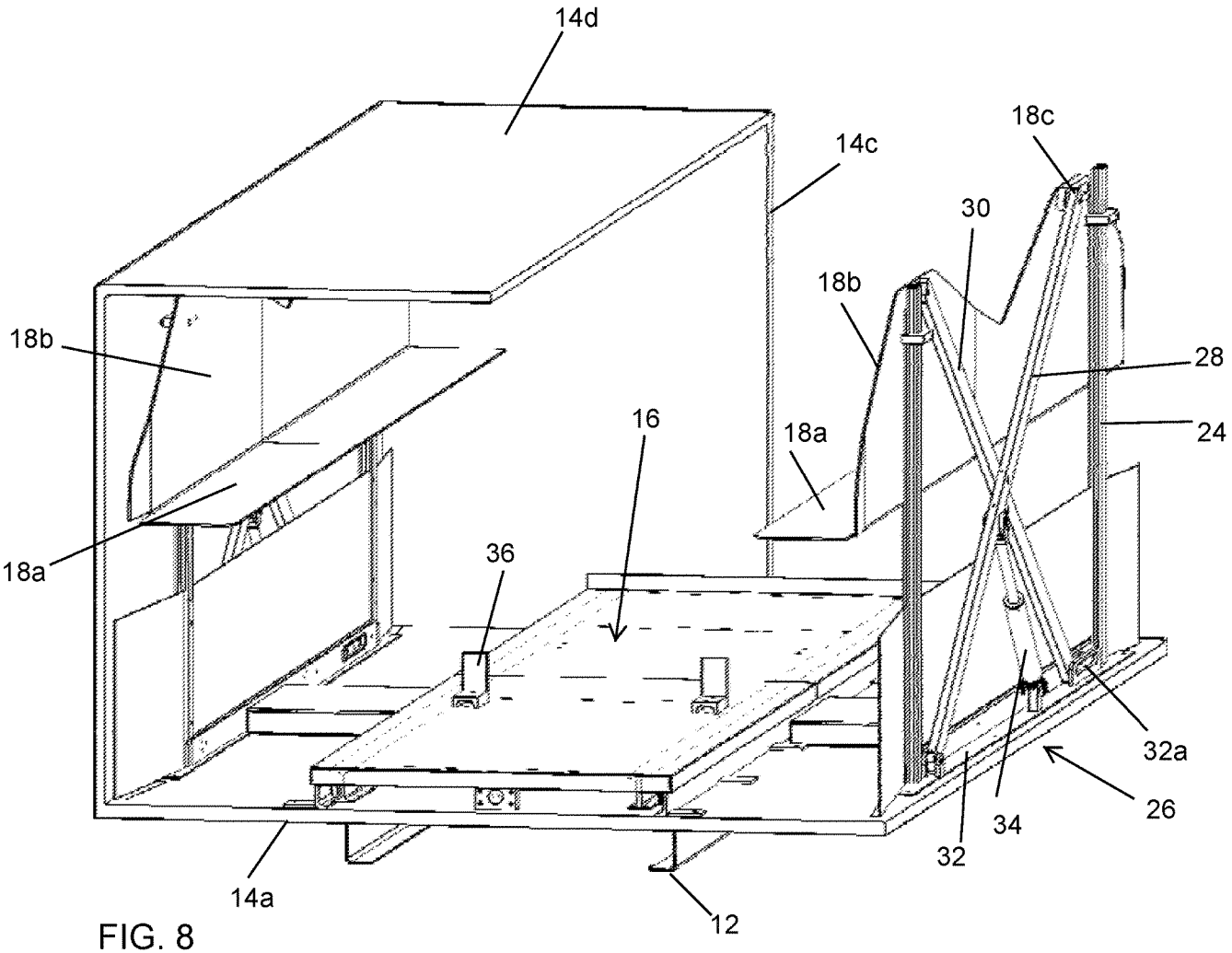
FIG. 8 is another perspective view of the transport container of FIG. 5, shown with a portion of the outer walls removed to show additional detail.
Figure 9:
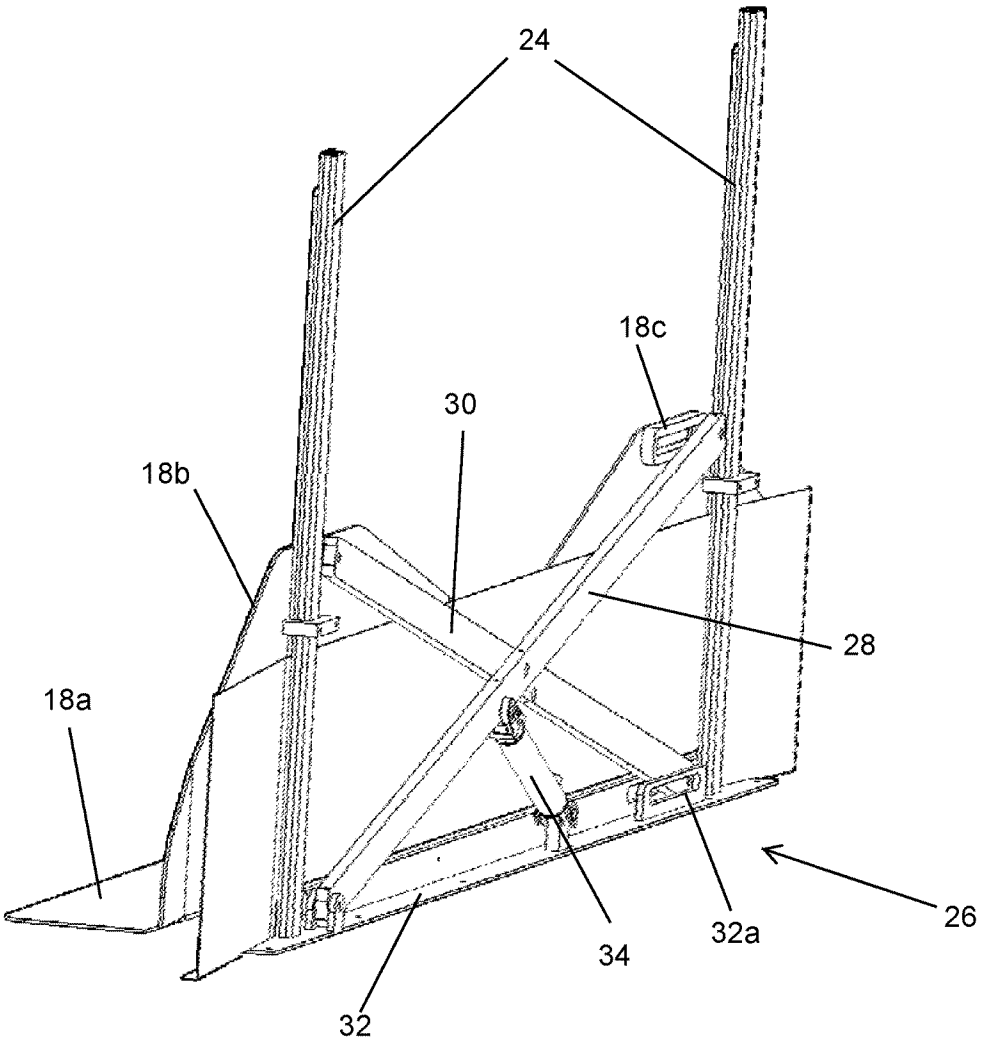
FIGS. 9 and 10 are perspective view of the shelf raising and lowering mechanism of the transport container of the present invention.
Figure 10:
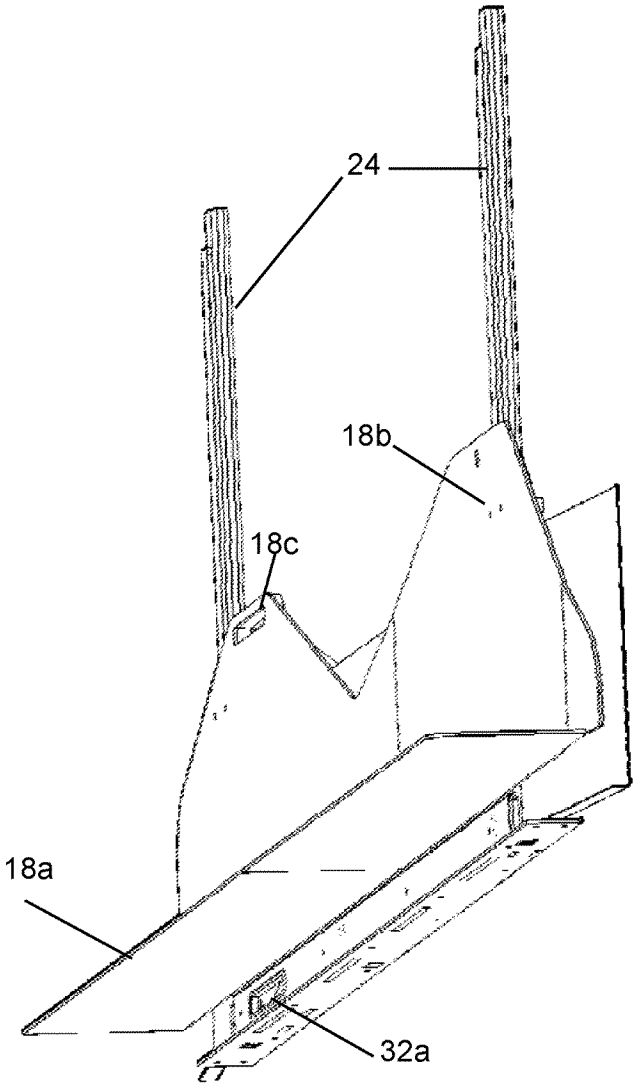
Figure 11:
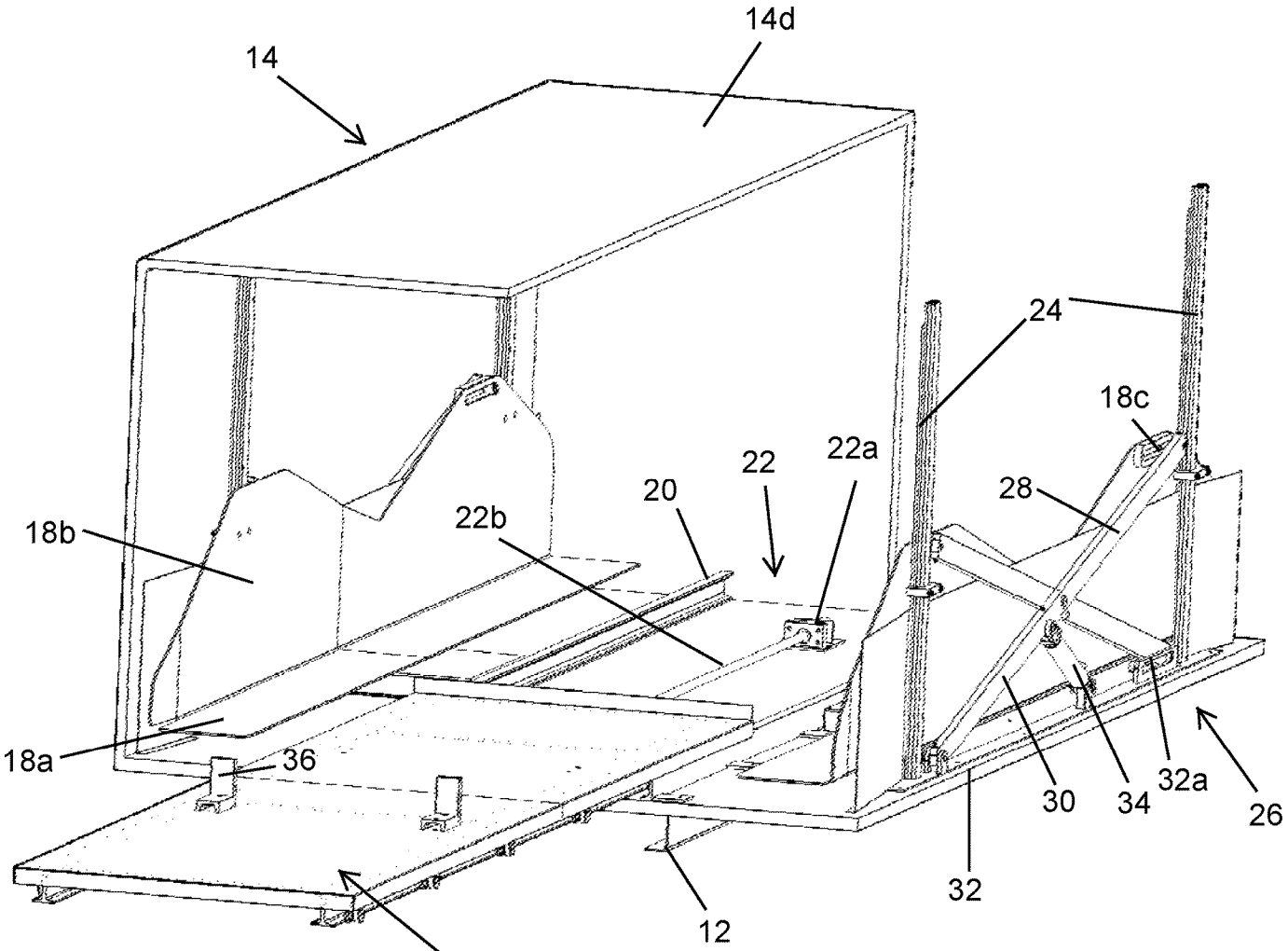
FIG. 11 is a perspective view of the transport container of the present invention, shown with the shelf lowered and the bed slide extended.
Figure 12:
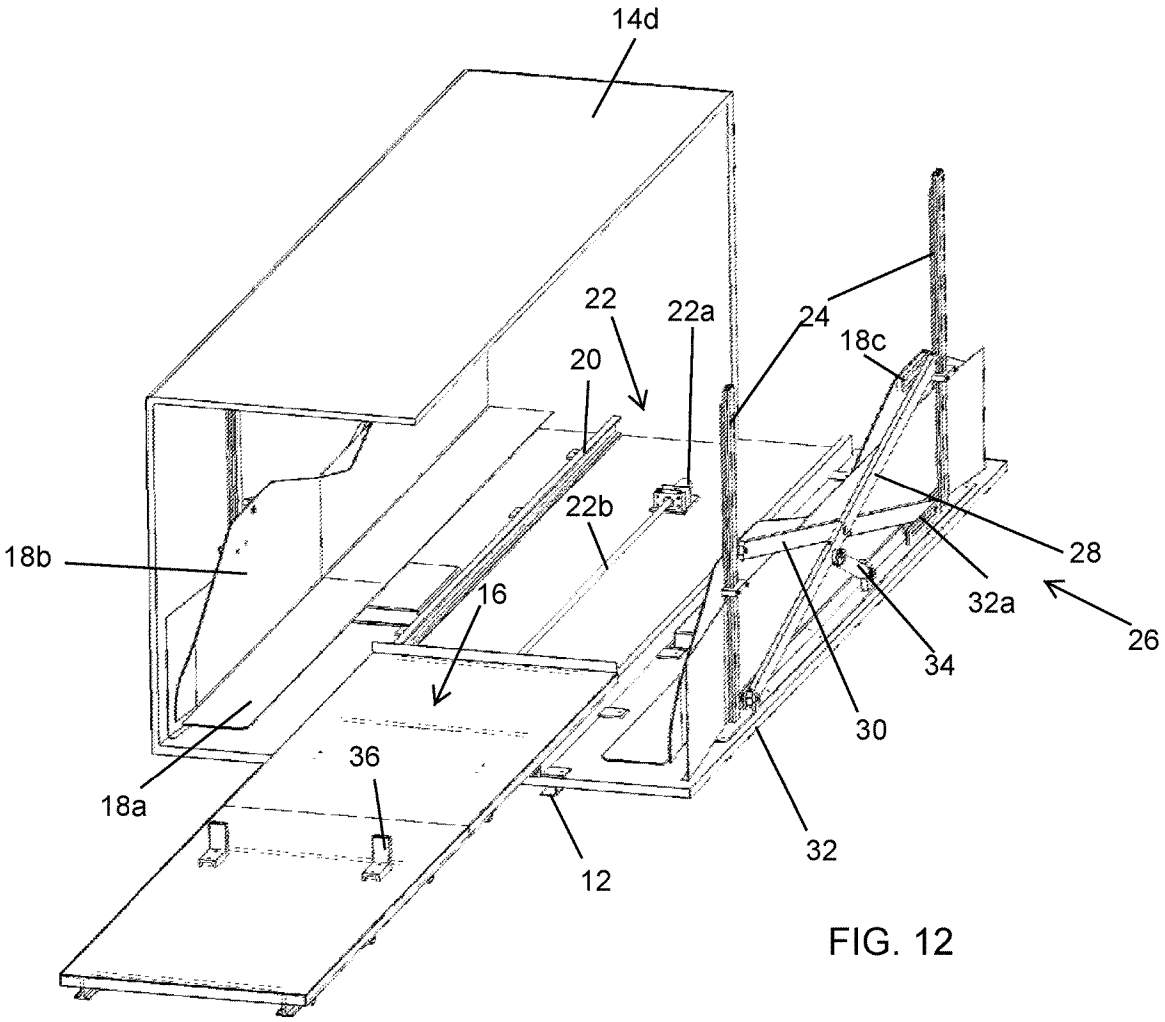
FIG. 12 is another perspective view of the transport container of FIG. 11.

Referring now to the drawings and the illustrative embodiments depicted therein, a transport container or carrier 10 is configured to be mounted at or attached at a vehicle (not shown), so that the transport container can be transported from one location to another for transporting a plurality of containers or articles therein, such as, for example, coffins or caskets or other large articles or containers. The transport container 10 includes a frame structure 12 that is configured for attachment at a vehicle trailer or bed or the like, with an outer housing 14 attached to the frame structure 12. The transport container 10 includes an extendable and retractable ramp or platform or bed slide 16 and raisable and lowerable shelves 18, which cooperate to load two rows of articles in the housing 14 without requiring manual lifting of the articles, as discussed below. The articles are loaded without the operator having to enter the transport container, as also discussed below. Because the articles are loaded without requiring any loading personnel to walk into the container 10, the present invention provides a low profile container to provide a more aerodynamic container and vehicle.

The housing 14 may comprise any suitable housing having a floor 14*a*, side walls 14*b*, a front end wall 14*c* and a top 14*d*. For example, the housing may comprise a metal housing or the like. A door is provided at the rear end of the housing and is openable to load and unload the articles and closeable when the articles are loaded/unloaded for transporting the transport container and articles loaded therein.

Figure 16:
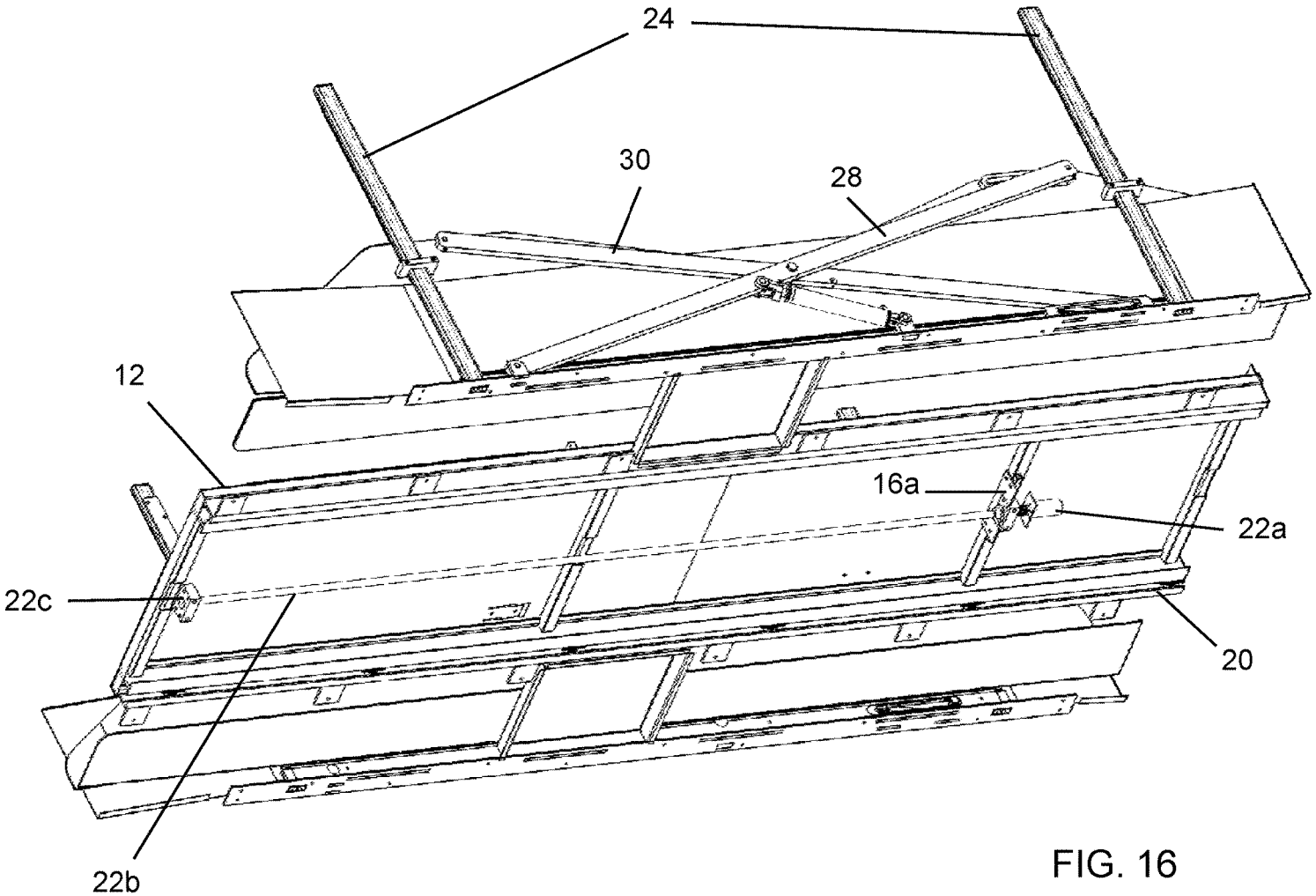
FIG. 16 is an underside perspective view of the transport container of the present invention, shown with the shelf lowered and the bed slide retracted, and with the outer walls removed to show additional details.
Figure 17:
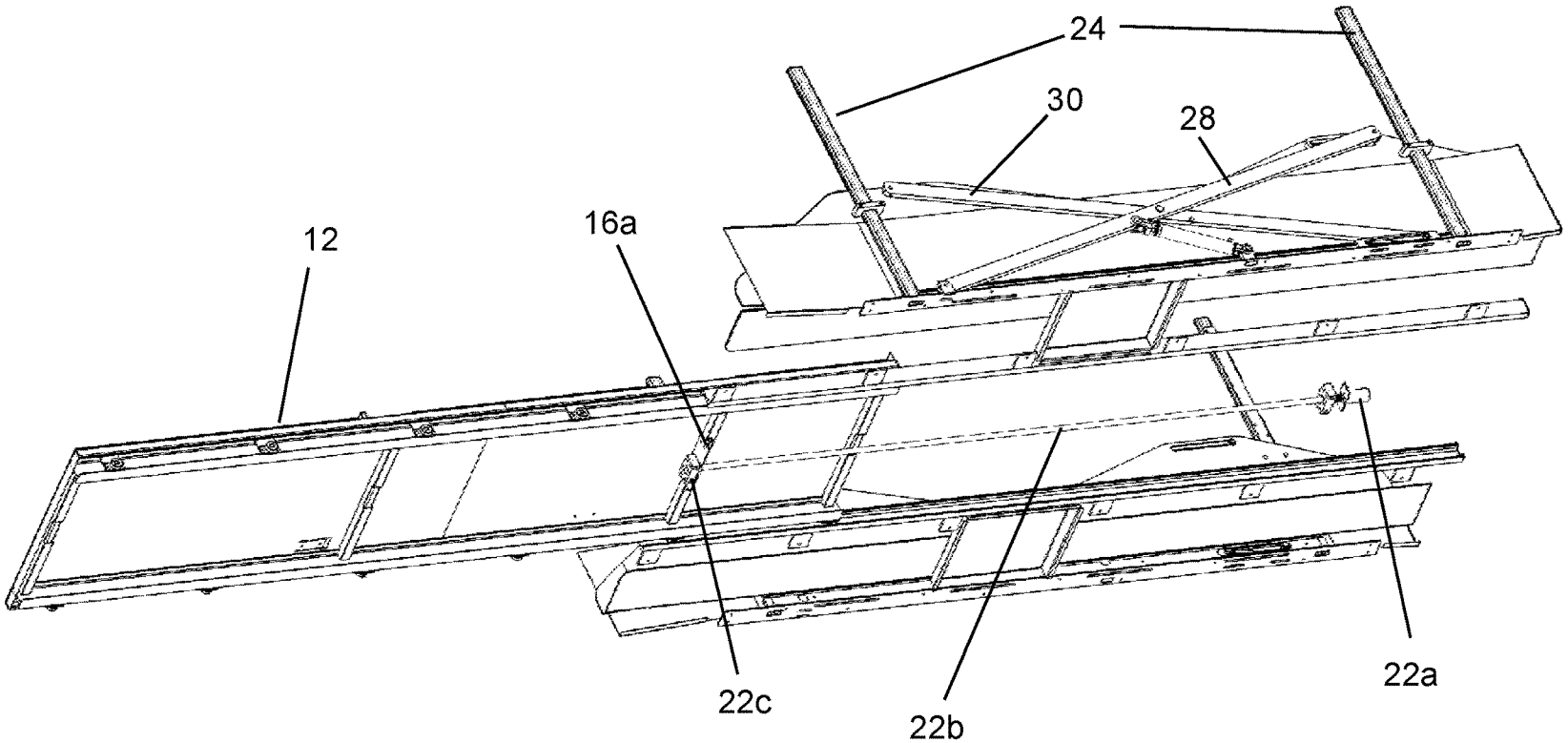
FIG. 17 is another underside perspective view of the transport container of the present invention, shown with the shelf lowered and the bed slide extended, and with the outer walls removed to show additional details.

The ramp or bed slide 16 includes a plurality of rollers that roll along and within opposite channels 20 disposed along the floor 14*a* of the container housing. The bed slide is extendable and retractable via an actuator 22, such as a rotational driving actuator or motor 22*a* (such as an electrically-powered motor or a hydraulic motor) that rotates a threaded rod 22*b*. As shown in FIGS. 16 and 17, the threaded rod 22*b* has one end supported at the motor 22*a* and the other end supported at an outer support 22*c* at the floor of the container. The threaded rod 22*b* threadedly engages a threaded structure 16*a* at the bottom of the bed slide 16. The threaded structure 16*a* (and the bed slide 16) thus moves along the threaded rod as the rod is rotated to extend or retract the bed slide relative to the housing. The threaded structure 16*a* may be positioned at a location along the bed slide 16 such that, when the bed slide is retracted, the threaded structure is at or near the motor 22*a* (FIG. 16), and when the bed slide is extended, the threaded structure is at or near the outer support 22*c* of the threaded rod (FIG. 17). Optionally, the threaded structure 16*a* may also function as a mechanical stop when it engages the outer support when the bed slide is fully extended. Although shown and described as a screw-drive type actuator, clearly other types of actuators, such as a hydraulic cylinder or the like, may be implemented to provide generally linear or translational movement of the bed slide relative to the floor of the carrier, while remaining within the spirit and scope of the present invention.

When retracted (FIGS. 1-8), the ramp or bed slide 16 is disposed between the spaced apart shelves 18. In the illustrated embodiment, the shelves 18 each comprise generally L-shaped shelves, with a support surface 18*a* for supporting articles loaded thereon, and an attachment portion 18*b* that attaches the respective shelf to a pair of vertically oriented supports 24. The shelves may slide or roll along the supports 24 responsive to adjustment by a raising/lowering mechanism 26.

Figure 13:
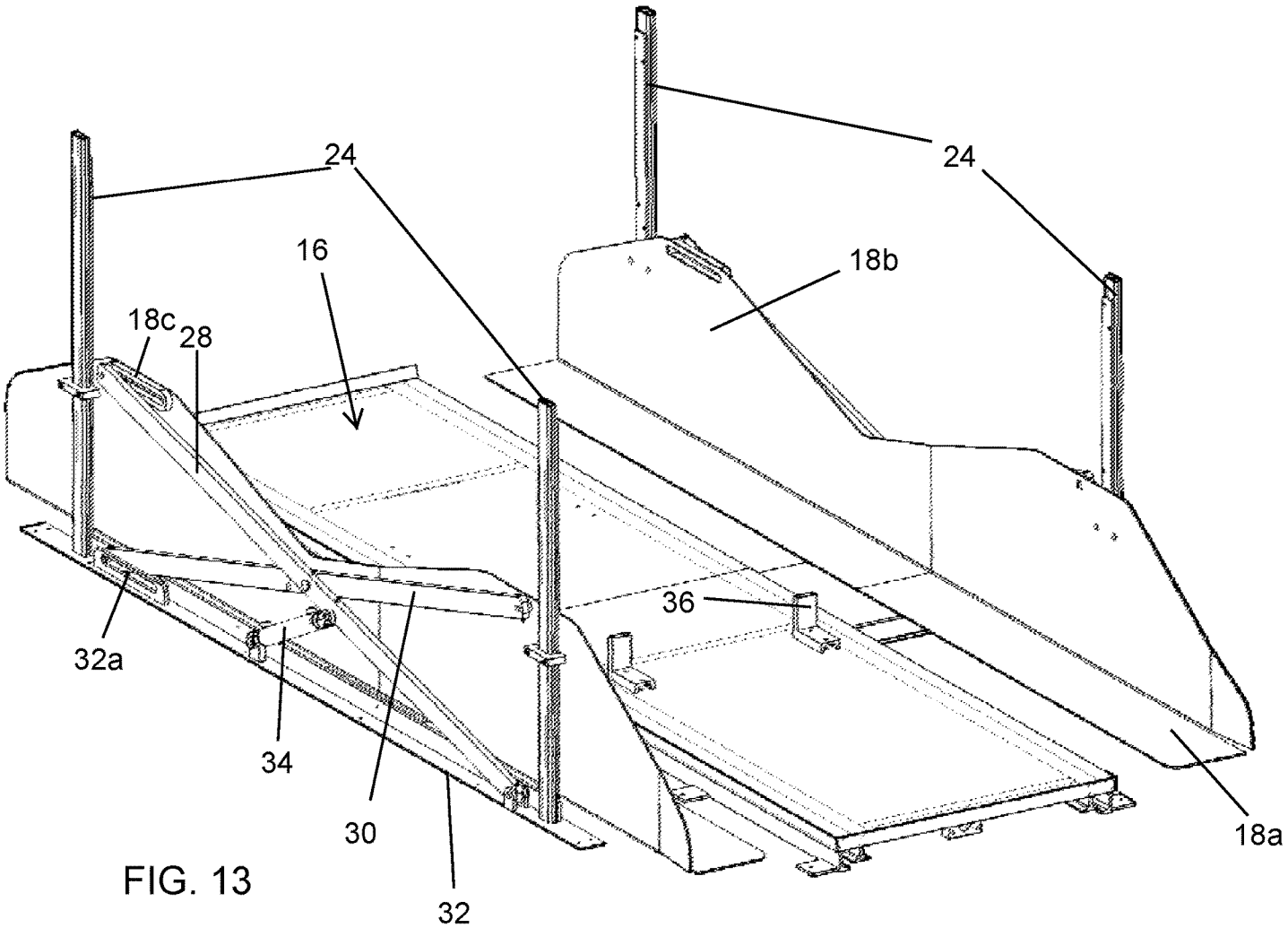
FIG. 13 is a perspective view of the transport container of the present invention, shown with the shelf lowered and the bed slide retracted, and with the outer walls removed to show additional details.
Figure 14:
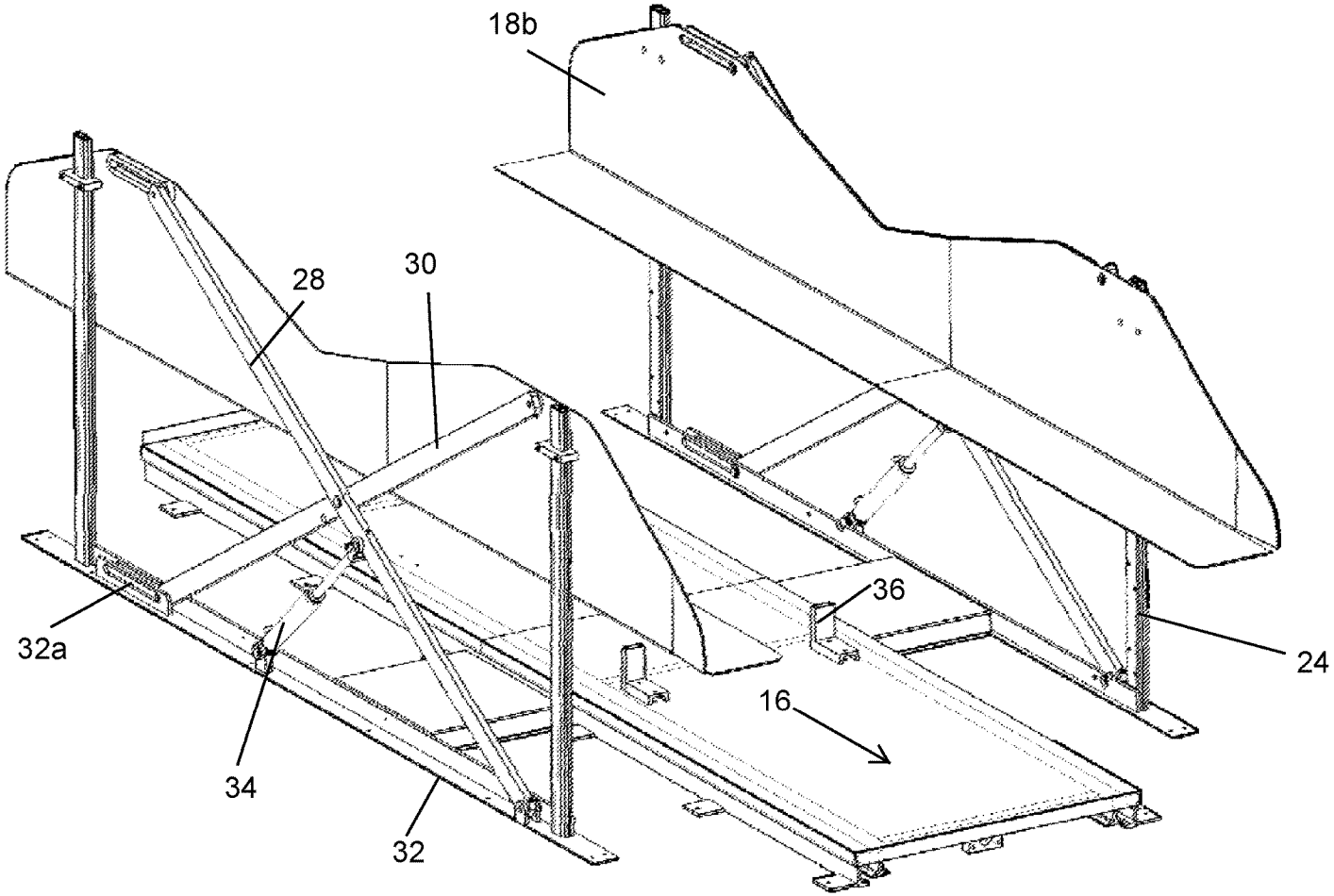
FIG. 14 is another perspective view of the transport container of the present invention, shown with the shelf raised and the bed slide retracted, and with the outer walls removed to show additional details.
Figure 15:
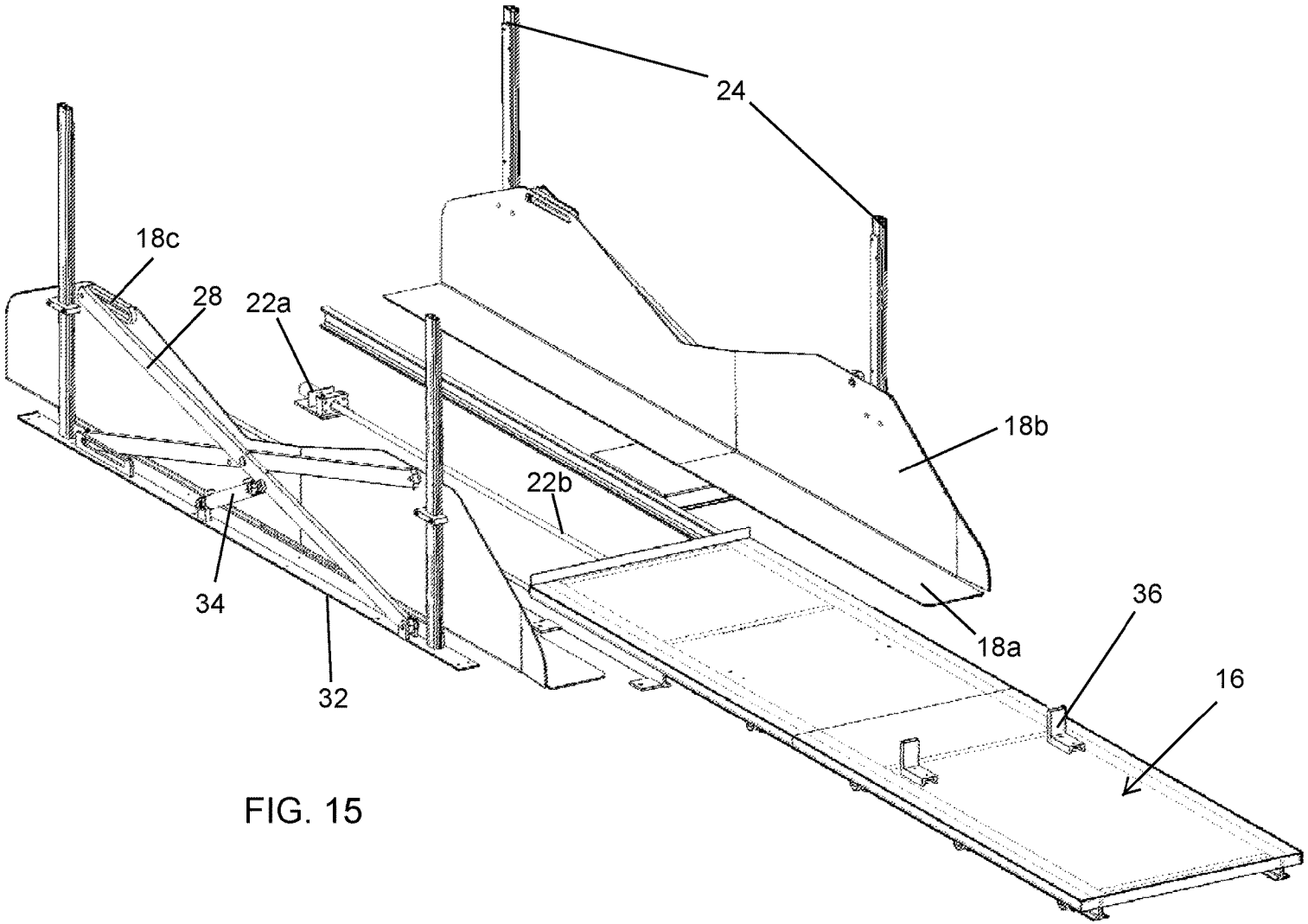
FIG. 15 is another perspective view of the transport container of the present invention, shown with the shelf lowered and the bed slide extended, and with the outer walls removed to show additional details.

In the illustrated embodiment, the raising/lowering mechanism 26 comprises a scissor mechanism that has two cross members 28, 30 pivotally joined at their center regions and attached at one end to the shelf attachment portion 18*b* and at the other end to a support structure 32 of the mechanism that is attached at the floor of the container. As best seen with reference to FIGS. 13 and 14, an upper end of one of the arms or members 28 is slidably or movably attached at and movable along a slot 18*c* of the shelf attachment portion 18*b*, while a lower end of the other of the arms or members 30 is slidably or movably attached at and movable along a slot 32*a* of the support structure 32 (with the opposite ends of the arms or members 28, 30 being pivotally attached at the support structure and shelf attachment portion, respectively). An actuator 34 (such as a hydraulic cylinder or other type of linear actuator) is pivotally mounted at and between the support structure 32 and one of the arms or members 28. Thus, when the actuator 34 is retracted, the arms 28, 30 function to lower the shelf along the vertical supports 24 (FIG. 13) and when the actuator is extended, the arms 28, 30 function to raise the shelf along the vertical supports 24 (FIG. 14), with the sliding or moving ends of the arms sliding or moving along the slots 18*c*, 32*a* as the shelf is raised and lowered. Although shown and described as a scissor-type raising/lowering mechanism, clearly other types of raising/lowering mechanisms, such as two or four post hoist designs or the like, may be implemented to vertically move the shelves relative to the floor and bed slide of the carrier, while remaining within the spirit and scope of the present invention.

When the shelves 18 are lowered, the support surface 18*a* of each shelf is disposed at or below a level of the upper surface of the ramp or bed slide 16. Thus, when articles are disposed on the bed slide and the bed slide is retracted, the ends of the articles are disposed over the support surfaces 18*a* of the shelves, whereby the shelves 18 may be raised to raise or lift the articles up from the bed slide to a raised position.

Thus, when loading articles (such as caskets) into the container or carrier 10, an operator may actuate a user input (such as a button or switch or lever) to cause the motor to extend the ramp or bed slide outward from the container. When the bed slide is fully extended (for example, for a fifteen foot long bed slide, the bed slide may extend out about twelve feet from the container), a plurality of caskets are loaded onto the bed slide side-by-side, with their head and feet ends extending from the respective sides of the bed slide (for example, six typical sized caskets may be loaded onto a fifteen foot long bed slide). After the bed slide is loaded, the operator actuates another user input (such as another button or switch or lever or the same input as before) to cause the motor 22*a* to retract the bed slide into the container. When the bed slide (and caskets) are in the container (with the shelves in their lowered position), the ends of the caskets are disposed over the shelves. The operator then actuates another user input (such as another button or switch or lever or the same input as before) to cause the actuator 34 to raise the shelves (and the first set of caskets) upward to their raised position (which is at least as high above the bed slide as the height of a large casket). The operator can then extend the bed slide again and load a second set of caskets onto the bed slide, and then retract the bed slide such that the bed slide (and second set of caskets) are disposed in the container and below the shelves and first set of caskets. The operator thus can load the container or carrier with two levels of caskets (such as twelve caskets) without having to set foot in the container or carrier. The operator can then close the rear door and the vehicle and container can be driven to deliver the caskets to the desired location or locations.

When unloading, the caskets can be unloaded in order (the lower or second set of caskets first, then the upper or first set of caskets). For example, an operator (such as at a funeral home) can open the container door and actuate the user input to extend the bed slide (with the second set of caskets), whereby one or more of the second set of caskets can be easily removed from the extended bed slide and placed on "church cart" (or other similar transport or cart) and wheeled into the funeral home. After the second set of caskets are unloaded, the shelves are lowered (with the bed slide in its retracted position) so that the first set of caskets are supported on the bed slide (as the shelves are lowered so their support surfaces are below the upper surface of the bed slide). The bed slide can then be extended again and one or more of the first set of caskets can be removed from the extended bed slide and placed on a cart and wheeled into the funeral home.

Optionally, for situations where the bed slide may be only partially loaded during transport, the bed slide may include one or more stop tabs or feet or stops 36 that are adjustably positioned along the bed slide. For example, if only three caskets are loaded as the second set of caskets (so that those three caskets will be transported while on the bed slide), the feet may be positioned half-way along the fifteen foot long bed slide. The feet thus may be positioned so as to hold the caskets in place on the bed slide, particularly if the bed slide is supporting less than full capacity of caskets. The feet thus keep the caskets from bouncing around in the container or carrier as it is driven or transported by the vehicle or truck. Optionally, the feet may be partially inserted into appropriate holes or slots along the bed slide after the caskets are loaded.

Therefore, the present invention provides a transport container for transporting two rows or levels of articles (such as caskets). The transport container can be loaded by a single operator, while avoiding any requirement for the operator to walk or crawl into the transport container. Although described herein as being particularly suitable for transporting multiple caskets or coffins, it is envisioned that the transport carrier or container of the present invention is suitable for use in transporting other large articles or items or containers, while remaining within the spirit and scope of the present invention.

Changes and modifications in the specifically described embodiments may be carried out without departing from the principles of the present invention, which is intended to be limited only by the scope of the appended claims as interpreted according to the principles of patent law.

The invention claimed is:

1. A transport container comprising:

a frame structure configured to mount at a vehicle;

a housing attached to said frame structure;

an extendable and retractable platform that is movable between a retracted position, where said platform is disposed within said housing, and an extended position, where said platform extends from an end of said housing;

a pair of spaced apart shelves disposed at opposite sides of said frame structure and having respective support surfaces;

wherein said shelves are raisable and lowerable between a lowered position, where said support surfaces are at or near a level of said platform, and a raised position, where said support surfaces are raised above said platform;

wherein, when said platform is in the extended position, a plurality of first articles is placed on said platform;

wherein, with the first articles on said platform, and when said platform is moved to the retracted position, the first articles are disposed partially over said support surfaces of said shelves;

wherein, when said platform is in the retracted position, and with the first articles disposed partially over said support surfaces of said shelves, said shelves are raised to the raised position to raise the first articles above said platform;

wherein, with the first articles raised above said platform, and when said platform is moved to the extended position, a plurality of second articles is placed on said platform; and wherein, with the second articles on said platform, and when said platform is moved to the retracted position, the second articles are disposed on said platform below said shelves and the first articles.

2. The transport container of claim 1, wherein the first and second articles comprise caskets.

3. The transport container of claim 1, wherein raising and lowering said shelves is responsive to actuation of a user input by an operator.

4. The transport container of claim 1, wherein extending and retracting said platform is responsive to actuation of a user input by an operator.

5. The transport container of claim 1, wherein said shelves comprise L-shaped structures with a horizontal part of the L-shaped structures providing said support surfaces.

6. The transport container of claim 1, wherein said shelves are spaced apart and disposed along opposite sides of said frame structure, with said platform disposed between said shelves.

7. The transport container of claim 1, wherein said shelves are raisable and lowerable via a scissor mechanism that has two cross members pivotally joined at their center regions and attached at first ends to said shelves and at second ends to said frame structure.

8. The transport container of claim 1, wherein said platform is extended and retracted via rolling movement of rollers along channels along a lower a floor of said transport container.

9. The transport container of claim 1, wherein said platform comprises at least one stop element disposed thereat to engage an inner first or second article disposed on said platform to limit longitudinal movement of the first or second articles along said platform.

10. The transport container of claim 9, wherein said at least one stop element is adjustably disposed along said platform to accommodate a different number of first or second articles on said platform.

11. A method of loading articles into a carrier of a vehicle for transporting multiple articles, said method comprising:

providing a carrier, wherein the carrier comprises a housing, a platform, and a pair of spaced apart shelves disposed at and along opposite sides of the housing;

wherein the platform is movable between a retracted position, where the platform is disposed within the housing, and an extended position, where the platform extends from an end of the housing;

wherein the spaced apart shelves have respective support surfaces, and wherein the shelves are raisable and lowerable between a lowered position, where the support surfaces are at or near a level of the platform, and a raised position, where the support surfaces are raised above the platform;

extending the platform to the extended position and loading a plurality of first articles onto said platform;

retracting the loaded platform to the retracted position, where the first articles are disposed partially over the support surfaces of the shelves;

raising the shelves to the raised position to raise the first articles above the platform;

extending the platform to the extended position and loading a plurality of second articles onto the platform; and retracting the platform to the retracted position so that the second articles are disposed on the platform below the support surfaces of the shelves and below the first articles.

12. The method of claim 11, wherein the first and second articles comprise caskets.

13. The method of claim 11, wherein raising the shelves is responsive to actuation of a user input by an operator.

14. The method of claim 11, wherein extending and retracting the platform is responsive to actuation of a user input by an operator.

15. The method of claim 11, wherein the shelves comprise L-shaped structures with a horizontal part of the L-shaped structures providing the support surfaces.

16. The method of claim 11, wherein the platform is disposed between the shelves.

17. The method of claim 11, wherein the shelves are raisable and lowerable via a scissor mechanism that has two cross members pivotally joined at their center regions and attached at first ends to the shelves and at second ends to frame structure of the carrier.

18. The method of claim 11, wherein the platform is extended and retracted via rolling movement of rollers along channels along a lower a floor of the carrier.

19. The method of claim 11, further comprising providing at least one stop element at the platform to engage an inner first or second article disposed on the platform to limit longitudinal movement of the first or second articles along the platform.

20. The method of claim 19, further comprising adjusting the at least one stop element along the platform to accommodate a different number of first or second articles on the platform.

* * * * *